United States Patent [19]

Pálau

[11] Patent Number: 4,832,088

[45] Date of Patent: May 23, 1989

[54] HEDDLE FRAMES

[75] Inventor: Joseph Pálau, Duingt, France

[73] Assignee: S.A. Des Etablissements Staubli (France), Faverges, France

[21] Appl. No.: 194,906

[22] Filed: May 17, 1988

[30] Foreign Application Priority Data

May 21, 1987 [FR] France ..... 87 07354

[51] Int. Cl.[4] ..... D03C 9/06

[52] U.S. Cl. ..... 139/91

[58] Field of Search ..... 139/91, 92

[56] References Cited

U.S. PATENT DOCUMENTS 4,552,185 11/1985 Graf ..... 139/92

FOREIGN PATENT DOCUMENTS 215919 6/1961 Austria ..... 139/91

189216 5/1985 European Pat. Off. ..... 139/91

925562 5/1963 United Kingdom .

*Primary Examiner*—Henry S. Jaudon

*Attorney, Agent, or Firm*—Dowell & Dowell

[57] ABSTRACT

Heddle frames in which each upright includes an opening and a pair of spaced bearing surfaces and wherein each horizontal crosspiece includes a fixed and a movable jaw which extend outwardly therefrom and which jaws are engageable with the bearing surfaces upon adjustment of the movable jaws to thereby secure the horizontal crosspieces to the uprights.

10 Claims, 4 Drawing Sheets

HEDDLE FRAMES

BACKGROUND OF THE INVENTION

1. Field of the Invention

The present invention relates to heddle frames which are mounted on weaving looms and which are connected to a dobby or other mechanism for forming the shed, in order to produce a fabric in accordance with the desired weave.

2. History of the Related Art

As is known, heddle frames are constituted by the assembly of four separate elements, namely two superposed horizontal crosspieces and two lateral uprights. The edge of the crosspieces faces the inside and are fitted with a rail for fixing the hooks provided at the ends of the yarn-guide heddles. In order to facilitate positioning of these heddles, the upright-crosspiece assembly arranged in each of the corners of the frame is in easily dismountable form. The present invention is precisely based on the observation that the choice of the mode of assembly is more delicate than it might appear at first sight.

Certain constructions have adopted a system of assembly allowing a perfect rigidity of the frame to be obtained, but such a system often employs a relatively high number of separate pieces and fixing members, thus rendering the dismounting and reassembly manoeuvres fastidious. On the contrary, other solutions proposed have rendered operation easy, but this advantage is generally acquired to the detriment of solidity.

European Pat. No. 0189216 describes a system of dismountable assembly in which each upright comprises a nose element projecting laterally on the wall of the upright facing the inside of the frame and of which the horizontal edges form bearing surfaces adapted to cooperate with a fixed piece and a spring leaf. These two pieces are connected to each other by a locking screw in order to act as jaws for immobilizing the above-mentioned nose element.

It will be noted that, although such an arrangement ensures simplicity of manoeuvre due to the uniqueness of the screw for closing the jaws, it has the drawback of applying to the uprights of the frame bending moments due to the lateral offset of the projecting nose element with respect to the vertical axis of the uprights.

SUMMARY OF THE INVENTION

It is an object of the present invention to overcome these aforementioned drawbacks by providing a heddle frame for weaving looms, of the type constituted by the dismountable assembly of four elements comprising two superposed horizontal crosspieces and two lateral uprights, wherein at least one of the ends of each crosspiece is provided with a mobile jaw connected by a locking screw to a fixed jaw. With this construction, by manoeuvring the screw, the two jaws are applied against combined bearing surfaces provided on the adjacent end of the upright being assembled. The bearing surfaces are defined by at least one opening made in the wall of the upright which faces the jaws, so that the bearing surfaces lie in the axis of the upright in order to avoid any bending moment at the level thereof.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
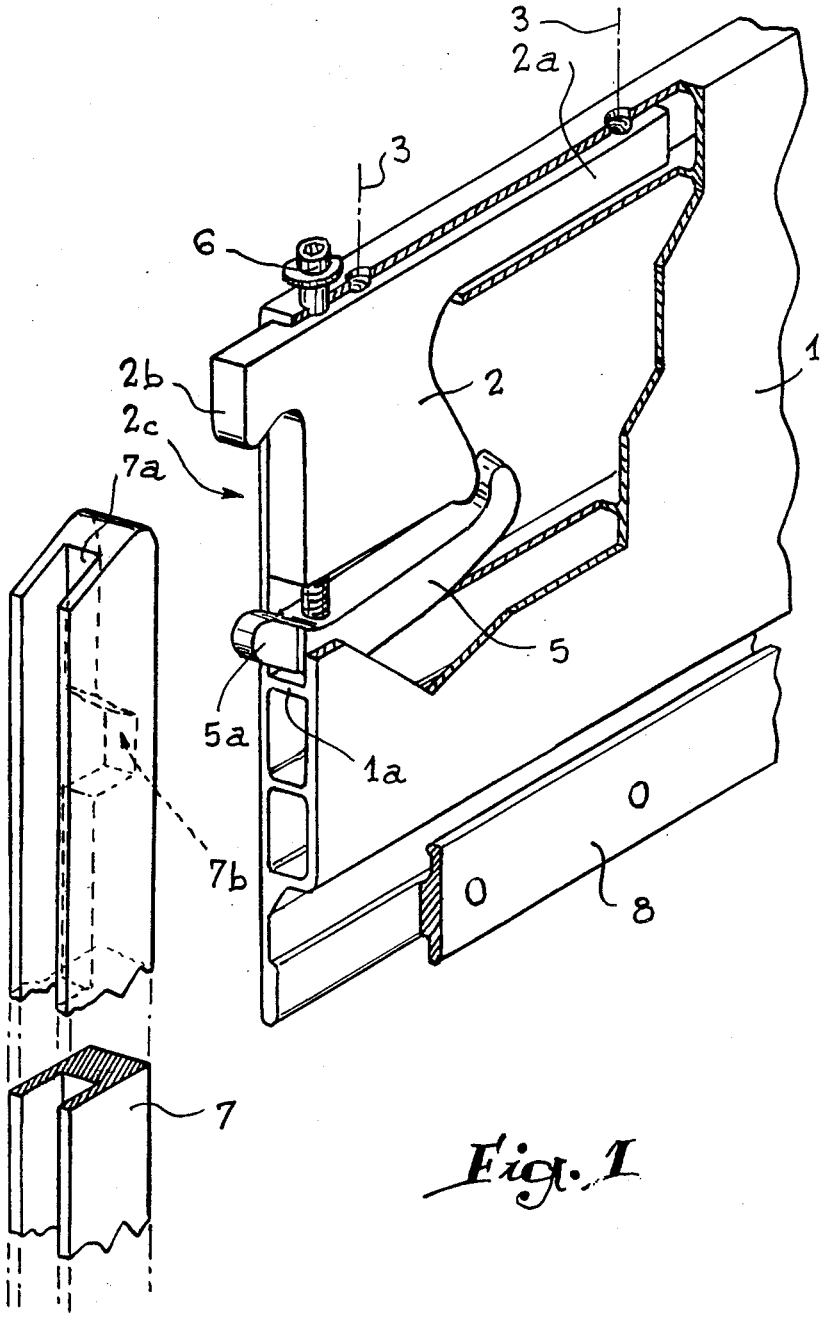
FIG. 1 is a view in perspective, with parts broken away, illustrating the arrangement of the pieces employed for assembly, located in one of the two upper corners of a heddle frame according to the invention.

Referring now to the drawings, reference 1 designates one of the two ends of the upper horizontal crosspiece of the frame in question. The crosspiece is formed, in manner known per se, by a hollow section reinforced by inner horizontal partitions. In the end 1*a* of this crosspiece is engaged a fixed jaw 2 provided with a horizontal heel 2*a* which is in position by means of the two screws 3 which secure a conventional lug 4 (as shown in FIG. 2) which lug is intended for anchoring the drawing member associated with the dobby.

Opposite the heel 2*a*, the jaw 2 includes a projecting nose element 2*b* adapted to form a clamping jaw, as will be more readily understood hereinbelow. Opposite this nose element or fixed jaw 2*b* lies a nose element or mobile jaw 5*a* provided at the end of an appropriately sectioned rocking jaw 5 connected to the fixed jaw 2 by a screw 6, as illustrated in FIGS. 2 and 3. It should be observed that jaws 2*b* and 5*a* define therebetween an opening 2*c* of substantially trapezoidal cross section, of which the small base faces the outside of the end 1 of the crosspiece in question.

This opening 2*c* is adapted to receive an assembly member 7*a* having the same trapezoidal section, which member is secured with the upper end of the corresponding upright 7 of the heddle frame. To that end, this upright 7, having a U-shaped cross section, has an opening 7*b* cut out at the level of its central web, which opening thus defines the member 7*a* mentioned above. Member 7*a* includes two opposite bearing surfaces 7*c* oriented obliquely to cooperate with the jaws 2*b* and 5*a*.

Figure 2:
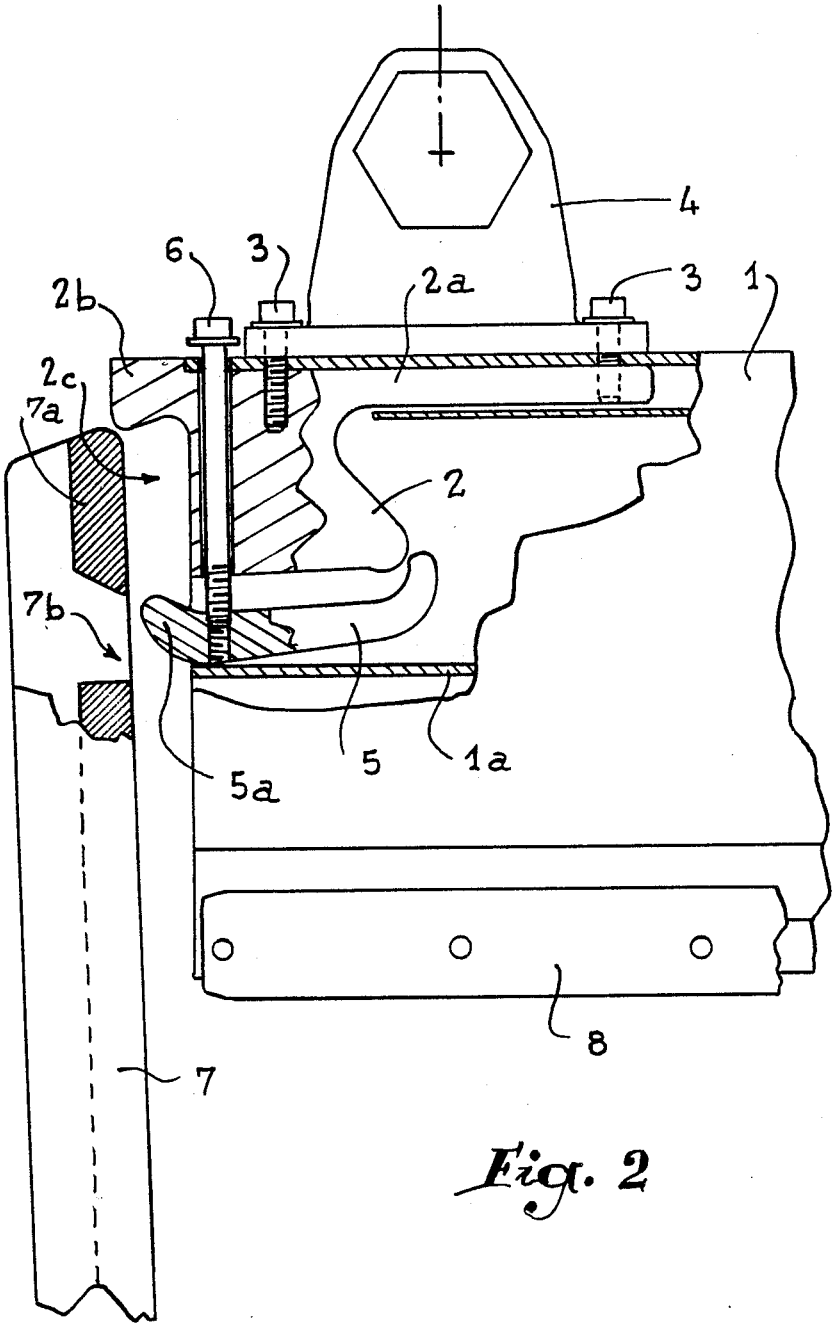
FIG. 2 is the corresponding side view, likewise with parts broken away.
Figure 3:
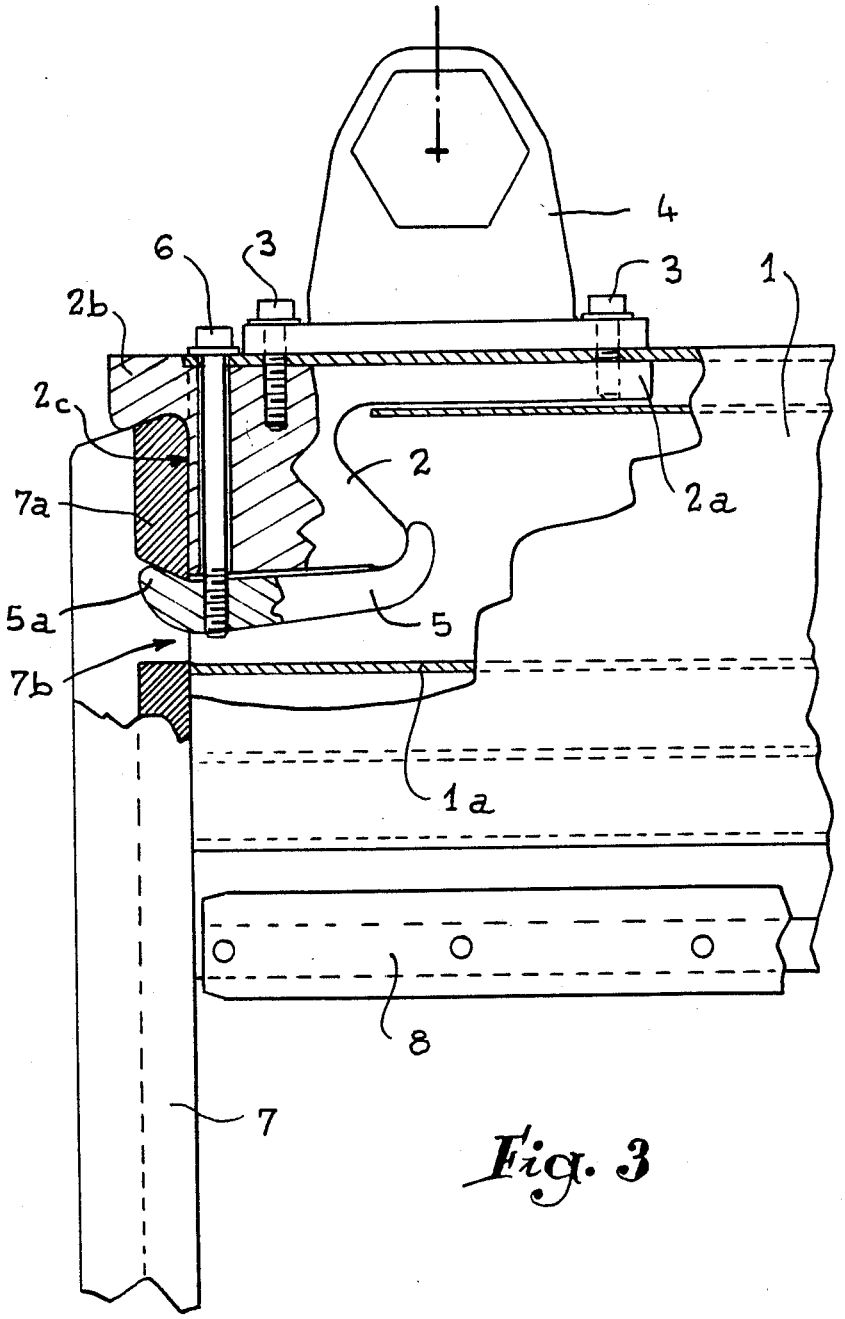
FIG. 3 reproduces FIG. 2 after assembly of the upright and of the crosspiece shown.

Under these conditions, it will be understood that, when the mobile jaw 5 has been brought, after screw 6 has been unscrewed, to the low position illustrated in FIGS. 1 and 2, in which it rests against a partition 1*a* of the crosspiece 1, the member 7*a* is capable of being introduced inside the opening 2*c* by inserting the top of the upright 7 therein. It then suffices to screw the screw 6 in order to effect displacement of the mobile jaw 5 upwardly. The jaw 5*a* will to some extent close the open lower part of the trapezoidal opening 2*c* of the fixed jaw 2.

As illustrated in FIG. 3, after the screw 6 has been manipulated to close jaw 5*a*, the member 7*a* is captive inside the opening 2*c*. The connection thus ensures a perfect rigidity due to the substantially trapezoidal section of the joint. It will be observed that mutual assembly is effected in the axis of the upright 7, without any overhang and without creation of bending moment.

Of course, this mode of assembly is advantageously adopted in the four corners of the heddle frame which, despite its resistance to deformation, is capable of being easily disassembled in order to replace the conventional yarn-guide heddles engaged on a horizontal rail 8 provided immediately below or above the inner horizontal edge of each crosspiece 1. The operations of assembly and of disassembly are simplified since they require only the manoeuvre of one screw 6 in each of the corners of the heddle frame, it being observed that this screw may be easily rendered captive.

It goes without saying that the uprights 7 may present any desired cross-section, the U-shaped construction shown hereinabove having been indicated only by way of example.

Figure 4:
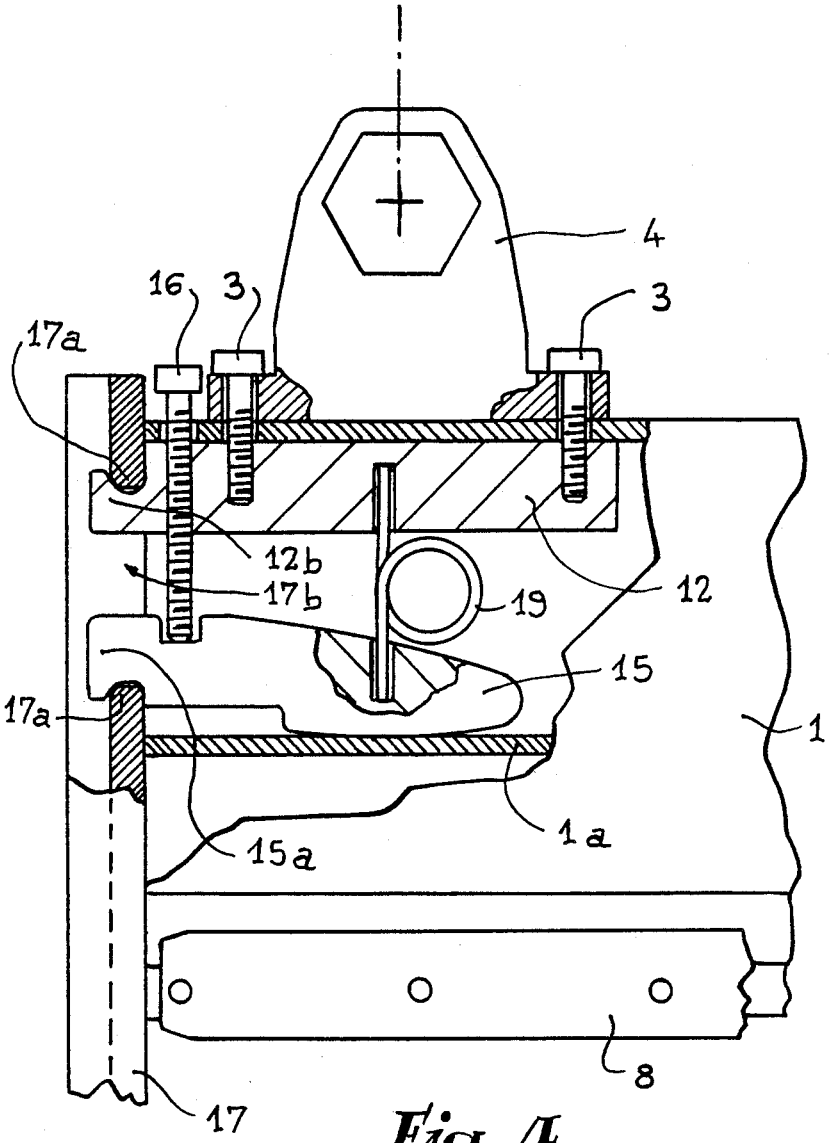
FIG. 4 illustrates a variant embodiment of the invention.

In the embodiment illustrated in FIG. 4, the fixed jaw, here referenced 12, comprises an upwardly facing nose element or jaw 12*b*, whilst the nose element or jaw 15*a* of the mobile jaw 15 faces downwardly. The two jaws 12 and 15 are connected to each other by a spring 19 which tends to apply the mobile jaw 15 against the inner partition 1*a* of the crosspiece. It will be readily understood that the nose elements or jaws 12*b* and 15*a* are adapted to be introduced into an opening 17*b* of the adjacent upright 17. The subsequent screwing of the screw 16 ensures spaced apart relationship of the two jaws which thus abut against the bearing surfaces 17*a* formed by the two opposite edges of the opening 17*b*, consequently ensuring the rigid assembly of the two elements 1 and 17 of the heddle frame.

What is claimed is:

1. In a heddle frame for weaving looms wherein the heddle frame includes at least one horizontal crosspiece and at least one upright, the improvement comprising, the horizontal crosspiece having at least one end having a fixed jaw element extending outwardly thereof and a movable jaw extending outwardly thereof and in spaced relationship to said fixed jaw, a locking screw means carried by the horizontal crosspiece and engaging said movable jaw so that said movable jaw is moved with respect to said fixed jaw by adjustment of said locking screw means, the upright having an end portion having an opening therein and a pair of spaced bearing surfaces generally aligned along an axis, at least one of said fixed jaw and said movable jaw extending through said opening, said end portion of the upright being receivable between said fixed jaw and said movable jaw so that said fixed jaw engages one of said bearing surfaces and said movable jaw engages the other of said bearing surfaces, and said movable jaw being urged against said other bearing surface by adjustment of said locking screw means so as to clamp said bearing surfaces against said fixed jaw and said movable jaw to thereby assemble the upright to the horizontal crosspiece without creating any bending moment along the end portion of the upright.

2. The heddle frame of claim 1 wherein the space between said fixed jaw and said movable jaw defines a shaped opening, said end portion of the upright including an assembly member having spaced ends and a shape complementary to said shaped opening so as to be cooperatively receivable within said opening, said spaced bearing surfaces being defined by said spaced ends of said assembly member.

3. The heddle frame of claim 2 wherein the upright is U-shaped in cross section having a central web, said opening in the upright being through said central web.

4. The heddle frame of claim 2 wherein the assembly member is substantially shaped as a trapezoid with each of said spaced bearings forming the shortened sides of the trapezoid, said spaced bearing surfaces being angled so as to face generally outwardly with respect to the horizontal crosspiece.

5. The heddle frame of claim 4 wherein said fixed jaw and said movable jaw are angled generally inwardly with respect to the horizontal crosspiece and said movable jaw is adjustable toward said fixed jaw by said locking screw means as said fixed jaw and said movable jaw are clamped into engagement with said space bearing surfaces.

6. The heddle frame of claim 5 in which said movable jaw extends through said opening in said upright.

7. The heddle frame of claim 6 in which said locking screw means extends through said fixed jaw and into engagement with said movable jaw.

8. The heddle frame of claim 1 wherein said opening in the upright is defined by opposing edges, said opposing edges defining said spaced bearing surfaces, and said fixed jaw and said movable jaw being extended through said opening.

9. The heddle frame of claim 8 wherein a spring means is mounted between and engages said fixed jaw and said movable jaw.

10. The heddle frame of claim 8 wherein said fixed jaw and said movable jaw are oppositely oriented and said movable jaw is urged by said locking screw means away from said fixed jaw in order to cause said fixed jaw and said movable jaw to engage said spaced bearing surfaces.

* * * * *